United States Patent [19]

Kremer

[11] Patent Number: 5,051,057

[45] Date of Patent: Sep. 24, 1991

[54] LATCH FOR A REVERSIBLE STABILIZER FOOT

[75] Inventor: Dennis A. Kremer, Dubuque, Iowa

[73] Assignee: Deere & Company, Moline, Ill.

[21] Appl. No.: 499,911

[22] Filed: Mar. 27, 1990

[51] Int. Cl.[5] ..... B60S 9/02

[52] U.S. Cl. ..... 414/685; 280/764.1

[58] Field of Search ..... 280/763.1, 764.1, 765.1, 280/766.1; 212/189; 414/680, 685; 182/111

[56] References Cited

U.S. PATENT DOCUMENTS

| | | | |
|---|---|---|---|
| 3,897,079 | 7/1975 | MacKenzie et al. | 280/764.1 |
| 3,901,532 | 8/1975 | Hornagold | 280/766.1 |
| 3,913,942 | 10/1975 | MacKenzie et al. | 280/764.1 |
| 3,998,470 | 12/1976 | Houston | 280/763.1 X |
| 4,295,661 | 10/1981 | Maurer | 280/765.1 |
| 4,531,883 | 7/1985 | Arnold | 280/763.1 X |
| 4,761,021 | 8/1988 | Lagsdin | 280/764.1 |
| 4,889,362 | 12/1989 | Lagsdin | 280/763.1 |

FOREIGN PATENT DOCUMENTS

| | | | |
|---|---|---|---|
| 492912 | 5/1953 | Canada | 182/111 |
| 1755327 | 8/1971 | Fed. Rep. of Germany | 280/763.1 |
| 242354 | 9/1969 | U.S.S.R. | 212/189 |
| 1351872 | 11/1987 | U.S.S.R. | 212/189 |
| 2204543 | 11/1988 | United Kingdom | 280/763.1 |
| 2207102 | 1/1989 | United Kingdom | 280/763.1 |

*Primary Examiner*—Robert J. Spar
*Assistant Examiner*—William M. Hienz

[57] ABSTRACT

The present invention provides a simple latching assembly for a reversible stabilizer foot for a backhoe. The latching assembly comprises a bolt having a rounded head that is biased into contact with the side edge of the reversible shoe when it is in its first position. The bolt is mounted to the stabilizer leg and is provided with an elastic sleeve that acts as a spring driving the rounded head of the bolt towards the side edge of the foot.

16 Claims, 2 Drawing Sheets

LATCH FOR A REVERSIBLE STABILIZER FOOT

BACKGROUND OF THE INVENTION

1. Field of the Invention

The invention is directed to a latch assembly for holding a stabilizer foot of a backhoe in a predetermined position.

2. Description of the Prior Art

Backhoe loaders are popular work vehicles for performing a variety of work operations. Typically the backhoe portion of the vehicle is provided with stabilizer legs that extend outwardly from the backhoe to engages the ground to provide firm footing for the implement. Some stabilizer legs maybe provided with reversible stabilizer feet having a dirt position and a street position. Such a reversible stabilizer foot is disclosed in U.S. Pat. No. 3,897,079.

On the applicant's backhoe loaders having reversible stabilizer feet, the applicant has previously used a catch comprising a strap that must be rotated into and out of position to hold the reversible foot in place. To secure the strap an operator needs to tighten and loosen a bolt resulting in a time consuming operation.

SUMMARY

It is an object of the present invention to provide a simplified latch assembly for a reversible stabilizer foot that can be easily utilized by an operator without tools.

The latch structure of the present invention comprises a pin mounted to the stabilizer leg that is biassed outwardly from the leg into contact with the side edge of the stabilizer foot when it is in its first position. The pin comprises a threaded bolt having a rounded head that engages the stabilizer foot. The bolt is bolted to the stabilizer leg and is provided with a spring for biassing the rounded head against the foot. A spring is positioned between the stabilizer leg and the rounded head. The spring is arranged concentrically around the bolt and comprises an elastic sleeve.

DETAILED DESCRIPTION

Figure 1:
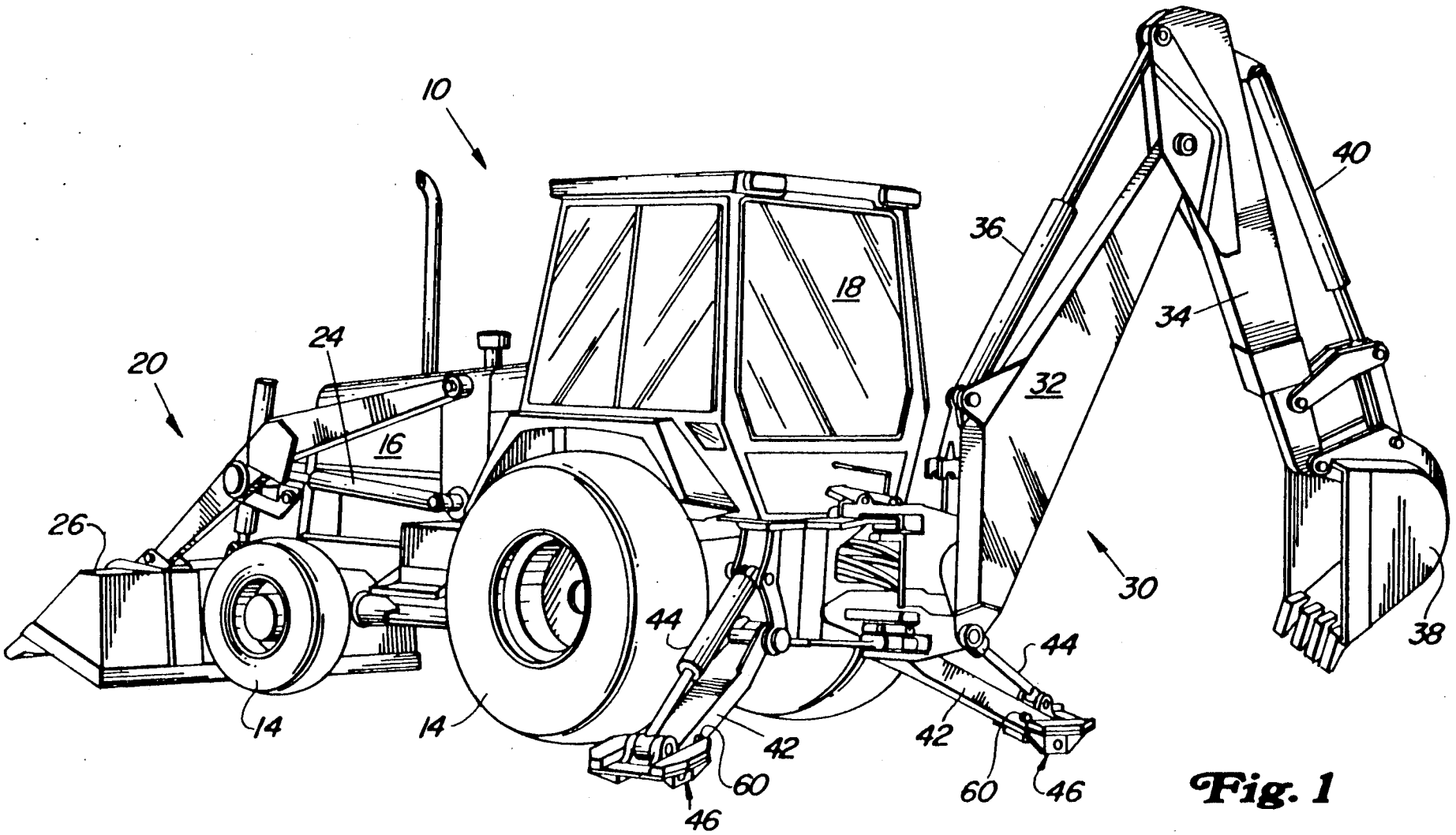
FIG. 1 is a perspective view of a backhoe loader.

The backhoe loader 10, illustrated in FIG. 1, is relatively conventional comprising a chassis 12 that is supported above the ground by ground engaging wheels 14. The chassis is provided with an engine compartment 16 and an operator's cab 18. At the front of the vehicle is loader assembly 20 having a boom 22, a boom-lift hydraulic cylinder 24, a bucket 26 and a bucket-tilt hydraulic cylinder 28. At the rear of the vehicle is backhoe assembly 30 having a boom 32, a boom-lift hydraulic cylinder (not shown), an extendible dipper stick 34, a dipper stick hydraulic cylinder 36, a bucket 38 and a bucket-tilt hydraulic cylinder 40.

Extending outwardly from the backhoe assembly 30 are stabilizer legs 42 having hydraulic cylinders 44 for positioning the legs. Reversible feet 46 are pivotally mounted to the ends of the stabilizer legs. Each of the stabilizer feet are provided with a first ground contacting surface and a second ground contacting surface.

The second ground contacting surface is the street surface 48. The street contacting surface is provided with rubber pads 50 that do not damage the streets when the stabilizer feet push down on a hard surface such as a street. The first ground contacting surface is the dirt surface 51 which is provided with downwardly depending steel ridges 52 for digging into soft dirt.

In FIG. 1 the backhoe loader is prepared for backhoe digging operations. The loader assembly 20 is down supporting the front of the vehicle and the stabilizer legs 42 are down supporting the rear of the vehicle. The stabilizer feet are in their first position with the dirt surface contacting the ground. The street surface faces up and the stabilizer feet are held in place by latching assembly 60.

Figure 2:
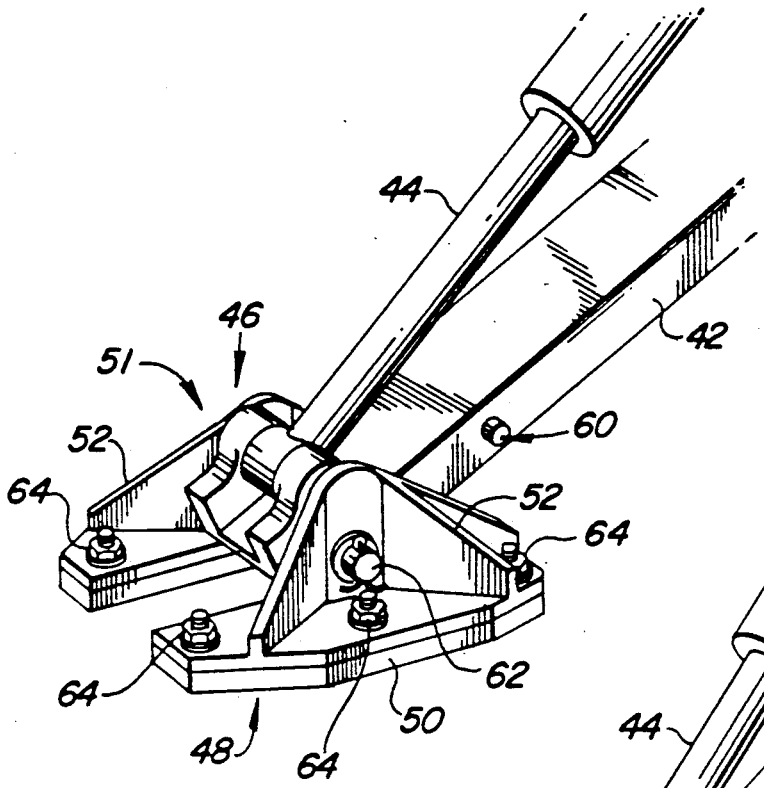
FIG. 2 is a perspective view of the stabilizer foot in its second position.
Figure 3:
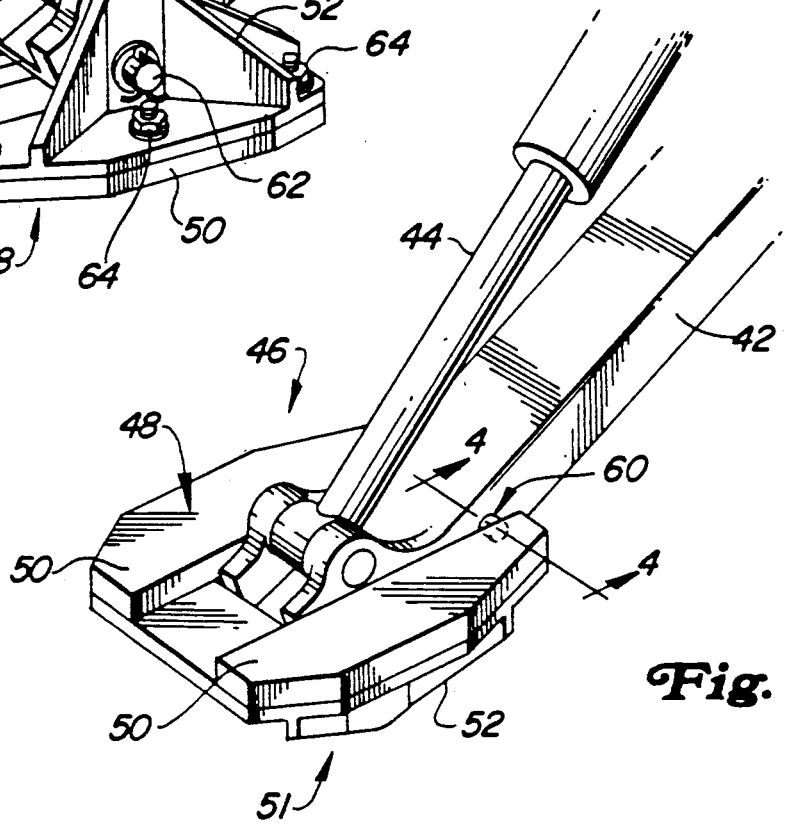
FIG. 3 is a perspective view of the stabilizer foot in its first position.
Figure 4:
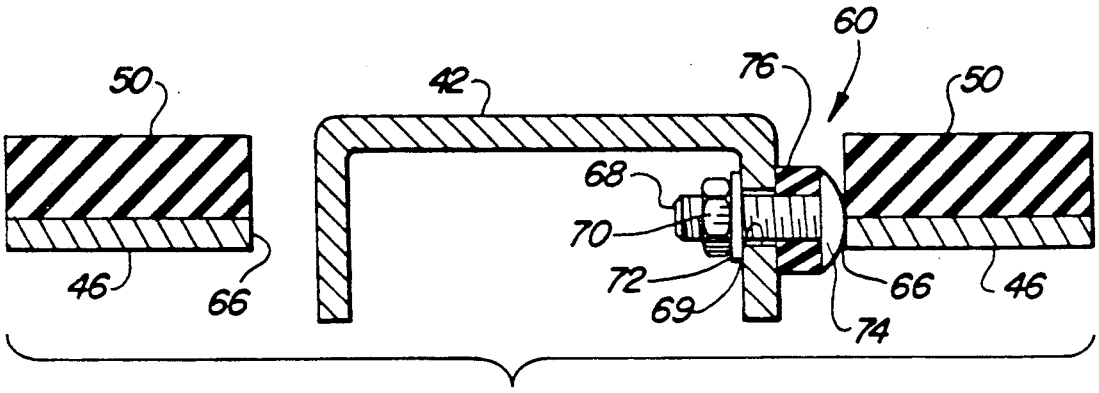
FIG. 4 is a cross sectional view of the latch assembly.

The latching assembly 60 is best illustrated in FIGS. 2–4. The stabilizer leg 42 comprises a frame formed of a channel member. Reversible stabilizer foot 46 is pivotally mounted to frame 42 by pivot pin 62. As illustrated in FIG. 2, the stabilizer foot is in its second position, that is the street surface having rubber pads 50 contacts the ground. The rubber pads 50 are secured to the foot by bolts 64.

When the foot is flipped into its first position illustrated in FIG. 3, latching assembly 60 holds the foot in place by contacting the side edge 66 of the foot.

The latching assembly comprises a threaded bolt 68 that is mounted to the stabilizer leg 42 at a hole 69 by a nut 70 and a washer 72. The bolt is provided with a rounded head 74 so that the side edge 66 of the stabilizer foot can be readily slid on and off the latching assembly 60. Spring 76 is concentrically arranged around bolt 68 between the leg 42 and rounded head 74. The spring comprises an elastic sleeve such as a uraflex ureathene spring. The spring biases the rounded head of bolt 68 towards the side edge 66 of the foot 46. Different compression forces can be applied to the spring by tightening nut 70.

The latch assembly of the present invention provides a simple device for holding a reversible stabilizer shoe in its first position. As such, it should not be limited by the above description, but should be limited solely by the claims that follow.

I claim:

1. A stabilizer leg for a backhoe, the leg comprising a frame;

a reversible stabilizer foot pivotally mounted to the end of the frame, the stabilizer foot having a first ground contacting surface and a second ground contacting surface, both surfaces are adapted to engage the ground depending on the position of the stabilizer foot relative to the frame; and a latch for holding the stabilizer foot in a first position where the first ground contacting surface engages the ground, the latch is mounted to the frame and is provided with a pin biassed outwardly from the frame by a spring, the pin contacting the stabilizer foot when the stabilizer foot is in its first position for holding the foot in the first position by the spring.

2. A stabilizer leg as defined by claim 1 wherein the stabilizer foot has a side edge adjacent to the frame which the pin of the latch contacts.

3. A stabilizer leg as defined by claim 2 wherein the pin of the latch is provided with a rounded head that contacts the side edge of the stabilizer foot.

4. A stabilizer leg as defined by claim 3 wherein the spring is positioned between the frame and the rounded head.

5. A stabilizer leg as defined by claim 4 wherein the spring is concentrically arranged about the pin.

6. A stabilizer leg as defined by claim 5 wherein the spring is an elastic sleeve.

7. A stabilizer leg as defined by claim 5 wherein the pin is a threaded bolt that is mounted to a hole in the frame by a nut.

8. A stabilizer leg as defined by claim 7 wherein the spring is an elastic sleeve.

9. A vehicle for performing a work operation, the vehicle comprising:

a chassis;

ground engaging means extending from the chassis for supporting the chassis above the ground;

a work implement mounted to the chassis for performing a work operation, the work implement is provided with a stabilizer leg having a frame which extends outwardly from the implement, the stabilizer leg is provided with a pivotal reversible stabilizer foot, the stabilizer foot having a first ground contacting surface and a second ground contacting surface, both surfaces are adapted to engage the ground depending on the position of the stabilizer foot relative to the frame, a latch for holding the stabilizer foot in a first position where the first ground contacting surface engages the ground, the latch is mounted to the frame and is provided with a pin biassed outwardly from the frame by a spring, the pin contacting the stabilizer foot when the stabilizer foot is in its first position for holding the foot in the first position by the spring.

10. A vehicle as defined by claim 9 wherein the stabilizer foot has a side edge adjacent to the frame which the pin of the latch contacts.

11. A vehicle as defined by claim 10 wherein the pin of the latch is provided with a rounded head that contacts the side edge of the stabilizer foot.

12. A vehicle as defined by claim 11 wherein the spring is positioned between the frame and the rounded head.

13. A vehicle as defined by claim 12 wherein the spring is concentrically arranged about the pin.

14. A vehicle as defined by claim 13 wherein the spring is an elastic sleeve.

15. A vehicle as defined by claim 13 wherein the pin is a threaded bolt that is mounted to a hole in the frame by a nut.

16. A vehicle as defined by claim 15 wherein the spring is an elastic sleeve.

* * * * *